US012037084B2

(12) United States Patent
Buynar

(10) Patent No.: US 12,037,084 B2
(45) Date of Patent: Jul. 16, 2024

(54) BOAT SEAT MOUNTING STAND

(71) Applicant: Alfred J. Buynar, Smith, AL (US)

(72) Inventor: Alfred J. Buynar, Smith, AL (US)

( * ) Notice: Subject to any disclaimer, the term of this patent is extended or adjusted under 35 U.S.C. 154(b) by 324 days.

(21) Appl. No.: 17/378,631

(22) Filed: Jul. 16, 2021

(65) Prior Publication Data

US 2022/0017184 A1 Jan. 20, 2022

Related U.S. Application Data

(60) Provisional application No. 63/052,617, filed on Jul. 16, 2020.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ... B63B 29/04; B63B 29/06; B63B 2029/043; B63B 2221/00; B63B 2221/20; B63B 69/00
USPC ..... 114/188, 194, 343, 363, 364, 382
See application file for complete search history.

(56) References Cited

U.S. PATENT DOCUMENTS

| | | | | |
|---|---|---|---|---|
| 4,318,567 | A * | 3/1982 | Guthier | A47C 9/10 297/188.21 |
| 4,645,167 | A * | 2/1987 | Hardwick | B63B 29/04 248/283.1 |
| 9,555,862 | B1 * | 1/2017 | Sutherland | B63B 17/04 |
| 9,821,889 | B2 * | 11/2017 | O'Neal | B63B 17/02 |
| 10,059,407 | B1 * | 8/2018 | Ingalls | B63B 17/02 |

* cited by examiner

*Primary Examiner* — Daniel V Venne
(74) *Attorney, Agent, or Firm* — Jones IP Law, LLC; Dennis W. Jones

(57) ABSTRACT

A boat seat mounting stand includes a sleeve member, an accessory member, an angular brace, and a horizontal brace for attaching an umbrella or other accessory to a typical pedestal mount boat seat. The sleeve member and the accessory member include adjustment handle configurations for securing to the pedestal mount and for securing an umbrella. The boat seat mounting stand provides for support and rotation of the attached umbrella around the boat seat.

15 Claims, 4 Drawing Sheets

BOAT SEAT MOUNTING STAND

CROSS-REFERENCE TO RELATED APPLICATIONS

This application claims the benefit of U.S. Provisional Application No. 63/052,617, entitled "Boat Seat Mounting Stand," filed Jul. 16, 2020, which is incorporated herein by reference as if set forth herein in its entirety.

BACKGROUND

This invention pertains to boat seats. More particularly, this invention pertains to a boat seat mounting stand that is attachable to a boat seat pedestal mount type support structure to provide for attaching an umbrella or other accessories for use with the boat seat.

BRIEF SUMMARY

According to one embodiment of the present invention, a boat seat mounting stand includes a sleeve member, an accessory member, an angular brace, and a horizontal brace for attaching an umbrella or other accessory to a typical pedestal mount boat seat, is provided. The sleeve member and the accessory member include adjustment handle configurations for securing to the pedestal mount and for securing an umbrella. The boat seat mounting stand provides for support and rotation of the attached umbrella around the boat seat. An umbrella is attachable to the boat seat mounting stand frame for providing shade when fishing in bright sun, rain, or hot weather.

In one embodiment, a pedestal mount of a typical pedestal mount boat seat extends through the sleeve member of the boat seat mounting stand and is attached to a boat deck in a typical mounting fashion.

According to one embodiment, the sleeve member and the accessory member are hollowed out tubular or cylindrical structures, while the horizontal brace member is a flat or plate structure extending between the sleeve member and the angular brace, and the angular brace member is a tubular structure extending between the sleeve member and the mid-section of the accessory member. The boat seat mounting stand is easily attached or detached from a typical boat seat.

In another embodiment, the boat seat mounting stand is adapted for securing a tray or other type accessory within reach of a fisherman or occupant of the boat seat.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which.

DETAILED DESCRIPTION

A boat seat mounting stand for a boat seat that provides for attaching an umbrella and/or other accessories to a boat seat support structure is disclosed. An umbrella is attachable to the boat seat mounting stand frame for providing shade when fishing in rain, bright sun, or hot weather.

Figure 1:
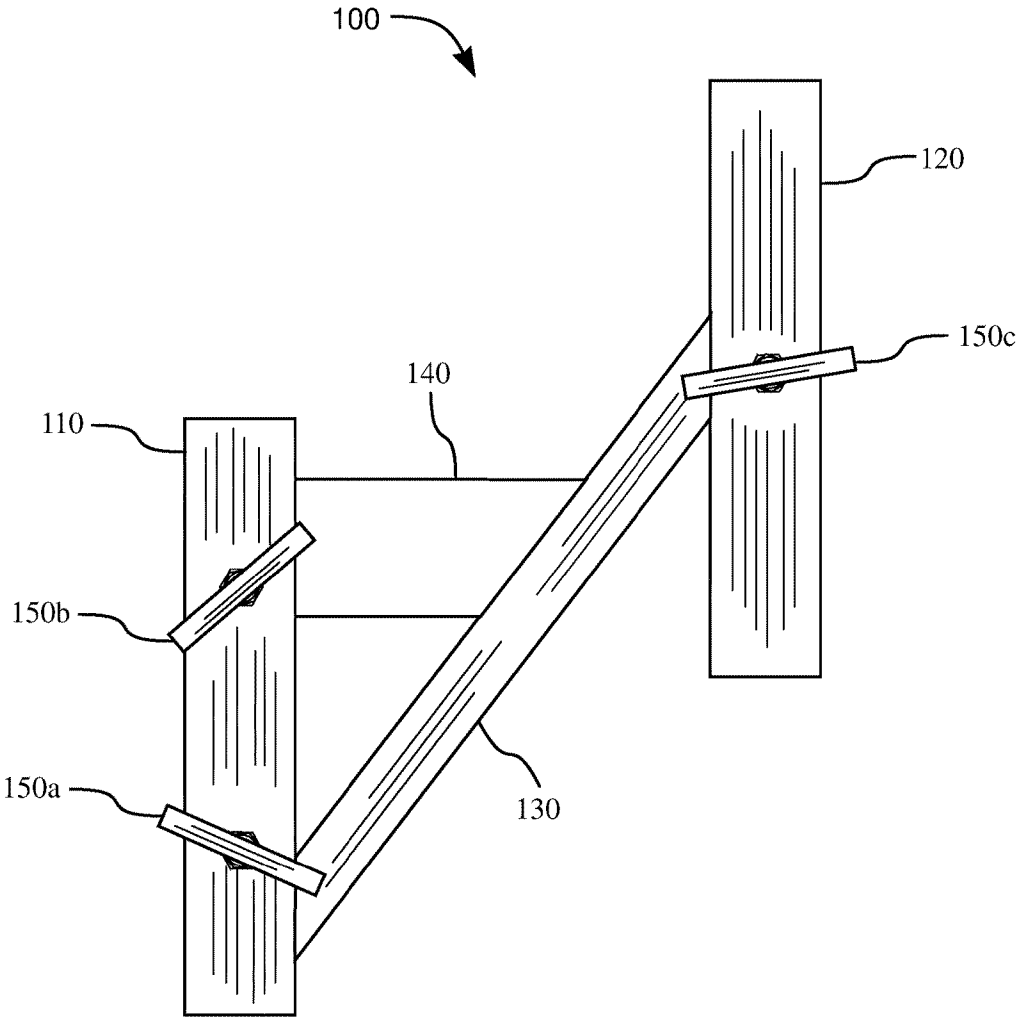
FIG. 1 is a side view of the boat seat mounting stand.

FIG. 1 is a side view of the boat seat mounting stand 100. The boat seat mounting stand 100 provides for attaching an umbrella or other accessory for use with a boat seat while fishing or just relaxing on the lake. An umbrella attached to the boat seat mounting stand 100 provides for shade when fishing in sunny conditions, or shelter when fishing in rainy conditions, for example. The boat seat mounting stand 100 includes a sleeve member 110, an accessory member 120, an angular brace 130, and a horizontal brace 140. The combination of an angular brace 130 and a horizontal brace 140 provides for improved strength in securing an accessory such as an umbrella in a stable manner. One of the many concerns with existing boat seat attachment mechanisms is the increased torque that the extra load puts on the boat seat support structure. It is not unusual for umbrella attachments to fail or lean in a manner that is undesirable, if not dangerous. Rough waters, winds, and unpredictable weather only add to the risks associated with an inferior umbrella attachment apparatus.

The boat seat mounting stand 100 also includes adjustment handle 150*a* and adjustment handle 150*b* for use in securing the sleeve member 110 to a boat seat pedestal. A similar adjustment handle 150*c* is provided for securing an accessory such as an umbrella stand within the accessory member 120.

Figure 2:
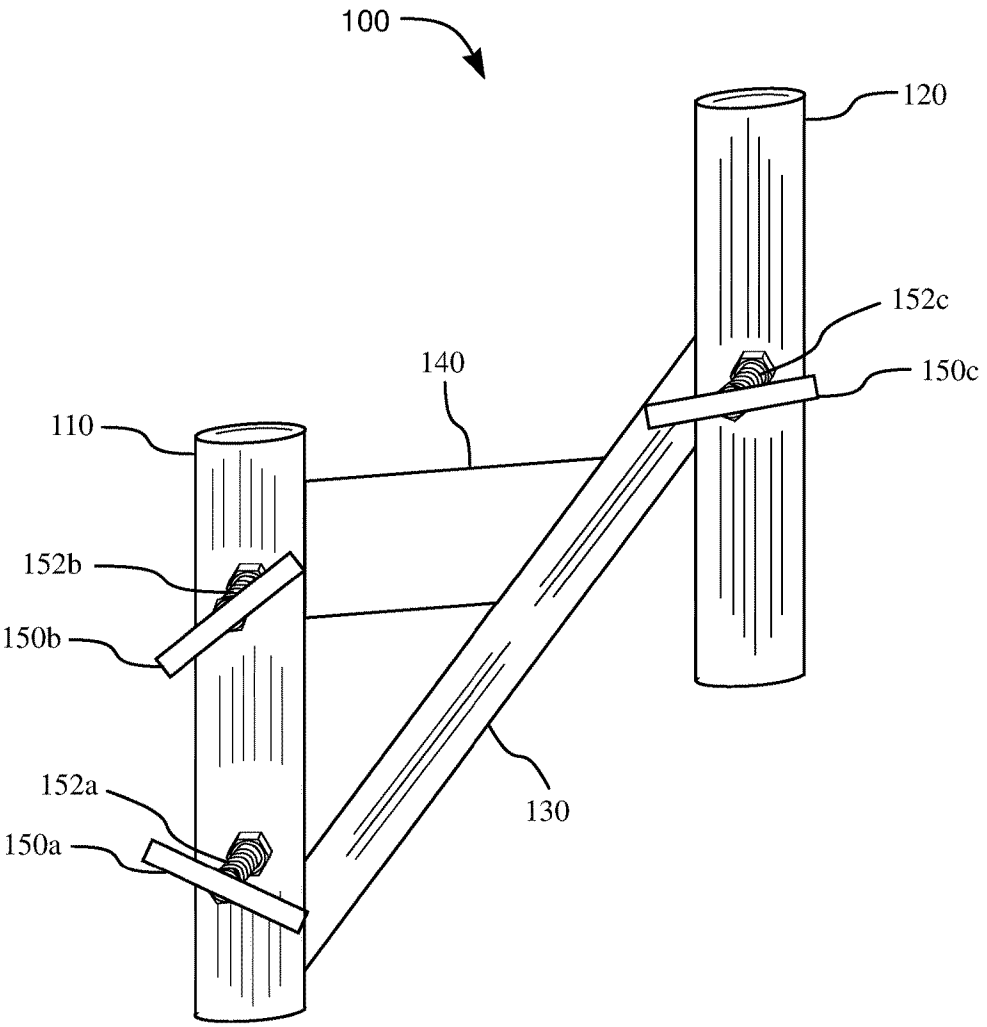
FIG. 2 is a perspective view of the boat seat mounting stand.
Figure 3:
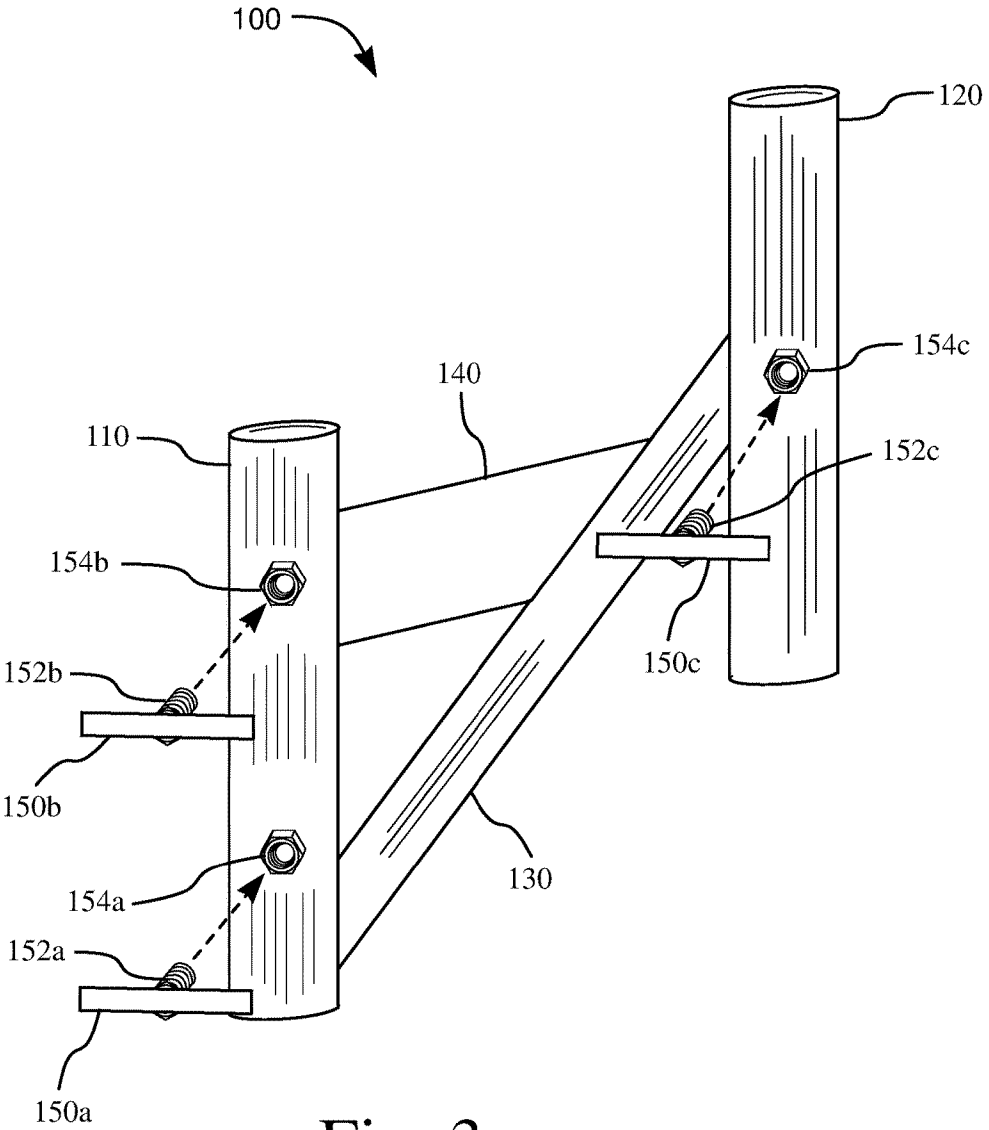
FIG. 3 is a partially exploded perspective view of the boat seat mounting stand.

FIG. 2 is a perspective view of the boat seat mounting stand 100 and FIG. 3 is a partially exploded perspective view of the boat seat mounting stand 100. In the illustrated embodiment, the sleeve member 110 is a hollowed cylindrical or tubular structure that provides an opening for sliding down over the boat seat pedestal mount of a typical fishing boat.

In the illustrated embodiment, the sleeve member 110 is a hollow, tubular structure having an opening of sufficient diameter along its length providing for a typical boat seat pedestal mount to extend entirely through the interior of the sleeve member 110. The hollow opening of the sleeve member 110 is of sufficient diameter that a pedestal mount of a typical boat seat can extend through the entire length of the sleeve member 110 opening. In various embodiments, the length of the sleeve member 110 is less than the length of the pedestal mount of a standard or typical pedestal mount boat seat.

In a typical embodiment, the sleeve member 110 is a hollow, tubular structure having an opening of sufficient diameter along its length providing for a typical boat seat pedestal to extend entirely through the interior of the sleeve member 110. A typical boat seat is secured to a boat seat pedestal mount that extends through the sleeve member 110 and is attachable and removable from the deck or floor of a boat. In the illustrated embodiment, the sleeve member 110 is a cylindrical or tubular structure so that the installation of the boat seat mounting stand 100 simply requires removal of the boat seat and/or pedestal mount from the floor or deck of the boat, insertion of the pedestal mount through the sleeve member 110, and then reattaching the pedestal mount to the floor or deck of the boat. Alternatively, installation can also be achieved by removing the boat seat from the pedestal and sliding the sleeve member 110 over the pedestal mount, and then reattaching the boat seat.

In the illustrated embodiment, the accessory member 120 is a cylindrical or tubular structure open at both ends. An umbrella stand or other type accessory is inserted into the open upper end of the accessory member 120 and adjusted vertically by utilizing the adjustment handle 150*c* to tighten the adjustment bolt 152*c* into or through the adjustment nut 154*c* to secure the adjustment bolt 152*c* against or into the umbrella stand 30 and hold it in place at the desired height relative to the level of the boat seat 20. To raise or lower the umbrella height, one simply loosens the adjustment bolt 152*c* via the adjustment handle 150*c*, adjusts the umbrella height, and then tightens the adjustment bolt 152*c* again.

In the illustrated embodiment, the accessory member 120 is open at both ends of the cylindrical structure. In other embodiments, it is envisioned that the lower end of the accessory member would be substantially closed to provide a lower support for the inserted rod of an accessory. In one embodiment, the end would have a small hole to allow for drainage so that the accessory member 120 does not fill with water or such.

The sleeve member 110 and the accessory member 120 each include adjustment configurations and/or adjustment mechanisms for securing the respective sleeve member 100 or accessory member 120 to a cylindrical structure within each. For example, the sleeve member 110 is typically secured to a boat seat pedestal, and the accessory member 120 is typically secured to an accessory such as an umbrella stand. In the illustrated embodiment, the adjustment configuration or adjustment mechanism includes an adjustment handle, an adjustment bolt, and an adjustment nut. The adjustment handle is secured to one end of the adjustment bolt, and the adjustment nut is secured to the respective sleeve member 110 or accessory member 120. Adjustment is made by inserting the adjustment bolt into the adjustment nut and tightening as necessary.

It is also envisioned that other type fastening mechanisms, as is known in the art, can be utilized for securing the respective sleeve member 110 to a boat seat pedestal, and similarly for securing an accessory within the accessory member 120.

The sleeve member 110 includes adjustment nuts 154*a* and 154*b* attached to and each covering an opening into the sleeve member 110. A respective adjustment bolt 152*a* and 152*b* corresponding to adjustment handles 150*a* and 150*b* respectively are used to secure the sleeve member 110 in place on the boat seat pedestal mount. While the illustrated embodiment includes two adjustment handle configurations, it is envisioned that a single adjustment handle configuration may sometimes suffice. In such a configuration, a single adjustment handle configuration including an adjustment handle and its corresponding adjustment bolt are utilized for securing to an adjustment nut on the sleeve member 110 as with the accessory member 120.

The accessory member 120 includes an adjustment nut 154*c* attached at and covering an opening into the accessory member 120. An adjustment bolt 152*c* and an adjustment handle 150*c* are used to secure an accessory, such as an umbrella stand, within the accessory member 120.

In the illustrated embodiment, each adjustment handle 150*a* and 150*b* and 150*c* is a cylindrical or tubular structure affixed to the head of a corresponding adjustment bolt 152*a* and 152*b* and 152*c*. The respective adjustment handle 150*a* and 150*b* and 150*c* are utilized to turn or screw the adjustment bolt 152*a* and 152*b* and 152*c* into the respective threaded adjustment nut 154*a* and 154*b* and 154*c*, at either the sleeve member 110 or the accessory member 120. It should also be noted that the adjustment handles 150*a* and 150*b* and 150*c* could also be bar type structures, flat structures, wing nut type grips, or any other handle type structure suitable for turning and securing a bolt type structure to a nut.

In the illustrated embodiment, the respective adjustment handles 150*a* and 150*b* and 150*c* are of sufficient length to provide the torque necessary for securing the respective adjustment bolt 152*a* and 152*b* and 152*c* into the respective threaded adjustment nut 154*a* and 154*b* and 154*c*.

In the illustrated embodiment, each adjustment handle configuration provides for securing the boat seat mounting stand 100 to the pedestal mount structure for a typical boat seat in a fishing boat or other type boats using similar pedestal mount structures. The adjustment handles 150*a* and 150*b* are utilized to tighten the adjustment bolts 152*a* and 152*b* into and/or through the respective adjustment nuts 154*a* and 154*b* and into the pedestal mount structure of the fishing boat. The adjustment nuts are affixed to corresponding openings substantially equidistant from either end of the sleeve member 110 to provide balance in securing the boat seat mounting stand 100 to the pedestal mount. Securing the boat seat mounting stand 100 to the pedestal mount ensures that the mounting stand 100 rotates with the boat seat as the user turns or rotates the seat. Of course, if the adjustment bolts are not tightened sufficiently to secure the mounting stand with the pedestal mount, then the boat seat mounting stand 100 will swing freely and independently of the boat seat.

In the illustrated embodiment of the boat seat mounting stand 100, an angular brace 130 extends from the lower or base end of the sleeve member 110 to the mid-section of the accessory member 120. In typical embodiments, the angular brace 130 is a cylindrical or tubular structure welded or otherwise affixed at or near one end of the sleeve member 110 and at the other end to the mid-section of the accessory member 120. Extending the angular brace 130 up from near the base of the sleeve member 110 provides for lifting the accessory member 120 to a higher elevation relative to the base of the sleeve member 110.

A horizontal brace 140 extends substantially perpendicularly from near the upper portion of the sleeve member 110 toward and connecting to the angular brace 130 near its upper end and typically below the level of the mid-section of the accessory member 120. In the illustrated embodiment, the horizontal brace 140 is a flat, plate type structure that is welded or otherwise affixed at one end to the upper portion of the sleeve member 110 and is welded or otherwise affixed along the angular length of the angular brace 130 as it extends angularly toward the mid-section of the accessory member 120.

In various embodiments, the boat seat mounting stand 100 components are constructed from materials that can be welded or otherwise affixed to each other, such as aluminum, stainless steel, steel, galvanized steel, plastic or other suitable materials that provide the strength, rigidity, and durability necessary for a structure to provide support for an umbrella stand 30 or any other accessories to be utilized with the boat seat mounting stand 100. It should be noted that many materials are suitable for providing the strength, rigidity, and durability of the structure while maintaining the ability to attach an umbrella 30 or other type accessory for use with a boat seat on a boat seat pedestal mount.

It should be appreciated that the intent is for an umbrella stand 30 to be securable to the accessory member 120 of the boat seat mounting stand 100. Of course, any other type accessory that includes a pole type stand can also be inserted into and secured within the accessory member 120.

The umbrella stand 30, or any other similar type structure that includes a pole type stand is attachable to the accessory member 120 of the boat seat mounting stand 100. In the illustrated embodiments, the umbrella stand 30 is attachable to the boat seat mounting stand 100 via sliding the stand of the umbrella stand 30 down inside the accessory member 120. The umbrella stand 30 is secured via adjustment of the adjustment handle 150*c* to secure the adjustment bolt 152*c* into or through the adjustment nut 154*c* and into the umbrella stand 30 as described above.

Figure 4:
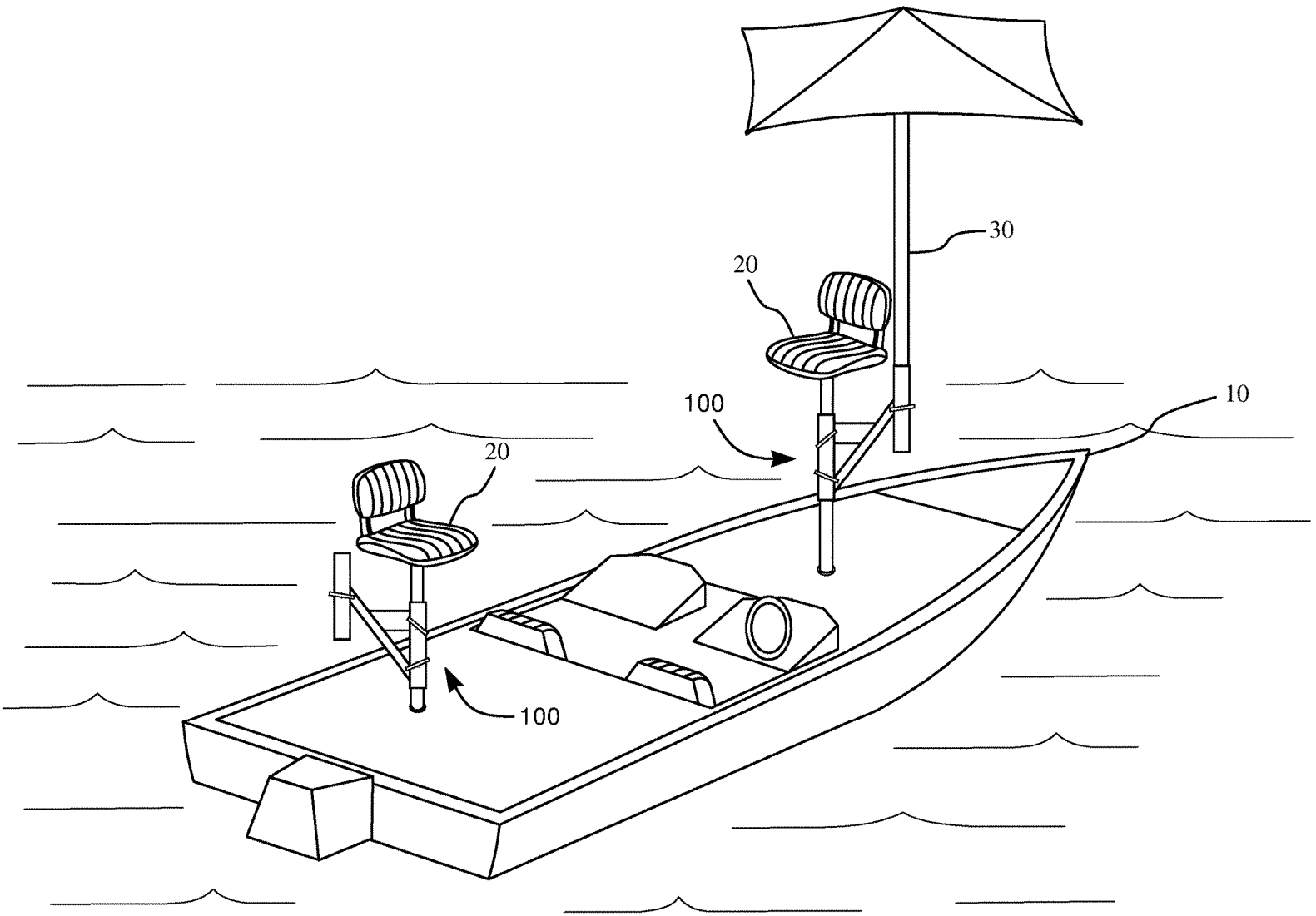
FIG. 4 is a perspective view illustrating a fishing boat with a boat seat including a boat seat mounting stand with an attached umbrella and a second boat seat also including a boat seat mounting stand.

FIG. 4 is a perspective view illustrating two separate boat seat mounting stands 100 being utilized on a fishing boat 10. One boat seat mounting stand 100 is configured with a boat seat 20 on the raised deck at the front of the boat 10. An umbrella stand 30 is secured to the boat seat mounting stand 100 corresponding to the boat seat 20. A second boat seat mounting stand 100 is situated on the floor at the rear of the boat 10. There is no umbrella stand secured to the rear boat seat mounting stand 100, though of course a second umbrella or other accessory could certainly be added, if desired or necessary.

It should be noted that the boat seat mounting stand 100 located at the rear of the boat 10 is of a reverse configuration from the boat seat mounting stand 100 at the front of the boat 10. That is, the adjustment handles 150*a* and 150*b* for the sleeve member 110 and the adjustment handle 150*c* for the accessory member 120 are situated on the opposite (right) side of the pedestal mount for the boat seat 20 at the rear of the boat 10. As such, in this configuration, the adjustments are on the right side of the boat seat 20 and to the right of anyone utilizing the boat seat 20. For the previously discussed configuration, the adjustments are on the left side of the pedestal mount and to the left of anyone utilizing the boat seat 20. It should be apparent, that the respective adjustment nuts 154*a* and 154*b* for the sleeve member 110, along with the corresponding adjustment bolts 152*a* and 152*b* and the corresponding adjustment handles 150*a* and 150*b* can be situated optimally on either side of the sleeve member 110 for effective utilization and adjustment. Similarly, the adjustment nut 154*c*, along with the corresponding adjustment bolt 152*c* and the corresponding adjustment handle 150*c*, may be situated on either side of the accessory member 120 for effective utilization and adjustment in securing an umbrella stand 30 or any other suitable accessory having a tube type stand structure. There is also no requirement that the adjustment handle 150*c* for the accessory member 120 be situated on the same or corresponding side as for the sleeve member 110. That is, the adjustment handle 150*c* may align with or be opposite the adjustment handles 150*a* and 150*b* for the sleeve member 110.

In the illustrated embodiment, the boat seat mounting stand 100 provides for attaching an umbrella stand 30 to the boat seat mounting stand 100 for use with the boat seat 20. It should be noted that the boat seat mounting stand 100 is adaptable for other type accessories where the added convenience of rotating the various type accessories around the boat seat 20 is a desirable feature. For example, the boat seat mounting stand 100 could also be adapted for securing a tray or tackle box within reach of a fisherman or occupant of the boat seat 20. It should be readily apparent that many other uses and/or accessories can be secured to the boat seat mounting stand 100 via the use of a pole stand adapted to the accessory and further adapted for insertion into the accessory member 120.

The umbrella stand 30 is a standard umbrella such as is used for providing shade and is similar to those found and/or utilized on beaches and lakes. The umbrella stand 30 is a pole type umbrella stand that is attachable to the accessory member 120 of the boat seat mounting stand 100. In the illustrated embodiment, the umbrella stand 30 is attachable to the boat seat mounting stand 100 via inserting the umbrella stand 30 within an upper opening of the accessory member 120. The umbrella stand 30 is secured via an adjustment handle 150*c* as described above.

The pedestal mount of the fishing boat 10 extends through the sleeve member 110. The pedestal mount is then attached to a boat deck or floor via any of the standard methods known in the art for attaching a pedestal mount to a boat or deck.

It should be noted also that the boat seat mounting stand 100 provides for rotating the attached umbrella with or separate from the boat seat 20. That is, the boat seat mounting stand 100 may be rotated so that the umbrella provides for shade to the fisherman at the best desired orientation. For rotation of the umbrella consistent with the boat seat 20, the adjustment handles 150*a* and 150*b* are utilized to secure the adjustment bolts 152*a* and 152*b* against the pedestal mount. For free rotation of the umbrella separate from the boat seat 20, the adjustment handles are utilized to release the adjustment bolts 152*a* and 152*b* away from the pedestal mount while still maintaining a connection between the respective adjustment bolts 152*a* and 152*b* and the adjustment nuts 154*a* and 154*b*.

The fishing boat 10 can be of any conventional construction that includes a pedestal mount boat seat. In the illustrated embodiment, the fishing boat 10 is an open fishing boat having a raised rear deck or platform and a raised front deck or platform for attaching a boat seat 20.

From the foregoing description, it will be recognized by those skilled in the art that a boat seat mounting stand 100 including a sleeve member 110, an accessory member 120, an angular brace 130, and a horizontal brace 140, for attachment to a boat seat mounting pedestal and capable of supporting an umbrella stand 30 or other accessory has been provided. The boat mounting stand 100 is attachable to a boat seat 20 via merely extending the mount pedestal of the boat seat 20 through the sleeve member 110 and attaching the mount pedestal to the boat deck or floor in typical fashion.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A boat seat mounting stand for securing to a boat seat pedestal to support an accessory attachment that includes a cylindrical pole structure, the boat seat mounting stand comprising:

a sleeve member having a hollowed cylindrical structure open at each end and providing for sliding over the boat seat pedestal;

an accessory member having a hollowed cylindrical structure open at each end and providing for receiving the accessory attachment that includes a cylindrical pole structure;

an angular brace extending from a base end of the sleeve member to a mid-section of the accessory member, providing for elevating the accessory member to a higher elevation relative to the sleeve member;

a horizontal brace extending from near an upper portion of the sleeve member toward and connecting to the angular brace nears an upper end of the angular brace and below the mid-section of the accessory member;

the sleeve member further comprising at least one hole for receiving a first adjustment mechanism for securing the sleeve member in position on the boat seat pedestal; and the accessory member further comprising at least one hole for receiving a second adjustment mechanism for securing the accessory attachment within the accessory member, wherein the boat seat pedestal attaches to a deck on a boat so that the boat seat mounting stand provides for rotation of the accessory member and included accessory attachment with rotation of a boat seat attached to the boat seat pedestal.

2. The boat seat mounting stand of claim 1, wherein the first adjustment mechanism is an adjustment screw that tightens to the boat seat pedestal.

3. The boat seat mounting stand of claim 1, wherein the second adjustment mechanism is an adjustment screw that tightens to the accessory attachment.

4. The boat seat mounting stand of claim 1, wherein the sleeve member has a length that is less than a pedestal mount length of a typical pedestal mount of a pedestal mount boat seat.

5. The boat seat mounting stand of claim 4, the sleeve member having a diameter, the diameter being sufficient for providing a typical boat seat pedestal mount to extend entirely through an interior length of the sleeve member.

6. The boat seat mounting stand of claim 1, wherein the angular brace is a cylindrical structure affixed at a first end to a base of the sleeve member and affixed at a second end to the mid-section of the accessory member.

7. The boat seat mounting stand of claim 1, wherein the horizontal brace is a flat, plate type structure extending substantially perpendicularly from an upper portion of the sleeve member toward and connecting to the angular brace near the accessory member.

8. A boat seat mounting stand for securing to a boat seat pedestal to support an accessory attachment that includes a cylindrical pole structure, the boat seat mounting stand comprising:

a sleeve member having a hollowed cylindrical structure open at each end and providing for sliding over the boat seat pedestal, the sleeve member having a length and a diameter, wherein the length is less than a corresponding length of a typical pedestal mount of a pedestal mount boat seat, and wherein the diameter is sufficient for providing a typical pedestal mount of a pedestal mount boat seat to extend entirely through an interior length of the sleeve member;

an accessory member having a hollowed cylindrical structure open at each end and providing for receiving the accessory attachment that includes a cylindrical pole structure;

an angular brace extending from a base end of the sleeve member to a mid-section of the accessory member, providing for elevating the accessory member to a higher elevation relative to the sleeve member;

a horizontal brace extending from near an upper portion of the sleeve member toward and connecting to the angular brace near it an upper end of the angular brace and below the mid-section of the accessory member;

the sleeve member further comprising at least one hole for receiving a first adjustment mechanism for securing the sleeve member in position on the boat seat pedestal; and the accessory member further comprising at least one hole for receiving a second adjustment mechanism for securing the accessory attachment within the accessory member, wherein the boat seat pedestal attaches to a deck on a boat so that the boat seat mounting stand provides for rotation of the accessory member and included accessory attachment with rotation of a boat seat attached to the boat seat pedestal.

9. The boat seat mounting stand of claim 8, wherein the first adjustment mechanism is an adjustment screw that tightens to the boat seat pedestal.

10. The boat seat mounting stand of claim 8, wherein the second adjustment mechanism is an adjustment screw that tightens to the accessory attachment.

11. The boat seat mounting stand of claim 8, wherein the angular brace is a cylindrical structure affixed at a first end to a base of the sleeve member and affixed at a second end to the mid-section of the accessory member.

12. The boat seat mounting stand of claim 8, wherein the horizontal brace is a flat, plate type structure extending substantially perpendicularly from an upper portion of the sleeve member toward and connecting to the angular brace near the accessory member.

13. A boat seat mounting stand for securing to a boat seat pedestal to support an accessory attachment that includes a cylindrical pole structure, the boat seat mounting stand comprising:

a sleeve member having a hollowed cylindrical structure open at each end and providing for sliding over the boat seat pedestal, the sleeve member having a length and a diameter, wherein the length is less than a corresponding length of a typical pedestal mount of a pedestal mount boat seat, and wherein the diameter is sufficient for providing the pedestal mount to extend entirely through an interior length of the sleeve member;

an accessory member having a hollowed cylindrical structure open at each end and providing for receiving the accessory attachment that includes a cylindrical pole structure;

an angular brace, wherein the angular brace is a cylindrical structure affixed to and extending from a base end of the sleeve member toward and affixed to a mid-section of the accessory member, providing for elevating the accessory member to a higher elevation relative to the sleeve member;

a horizontal brace, wherein the horizontal brace is a flat, plate type structure extending substantially perpendicularly from an upper portion of the sleeve member toward and connecting to the angular brace nears an upper end of the angular brace and below the mid-section of the accessory member;

the sleeve member further comprising at least one hole for receiving a first adjustment mechanism for securing the sleeve member in position on the boat seat pedestal; and the accessory member further comprising at least one hole for receiving a second adjustment mechanism for securing the accessory attachment within the accessory member, wherein the boat seat pedestal attaches to a deck on a boat so that the boat seat mounting stand provides for rotation of the accessory member and included accessory attachment with rotation of a boat seat attached to the boat seat pedestal.

14. The boat seat mounting stand of claim 13, wherein the first adjustment mechanism is an adjustment screw that tightens to the boat seat pedestal.

15. The boat seat mounting stand of claim 13, wherein the second adjustment mechanism is an adjustment screw that tightens to the accessory attachment.

* * * * *